US005762523A

United States Patent [19]

Clark et al.

[11] Patent Number: 5,762,523

[45] Date of Patent: Jun. 9, 1998

[54] DEVICE FOR MOUNTING AN ELECTRICAL CONNECTOR ON A PRINTED CIRCUIT BOARD

[75] Inventors: Stephen L. Clark, Dillsburg, Pa.; Robert E. Marshall, Jupiter, Fla.; William K. Nailor, III, Camp Hill, Pa.

[73] Assignee: Berg Technology, Inc., Reno, Nev.

[21] Appl. No.: 622,207

[22] Filed: Mar. 27, 1996

[51] Int. Cl.[6] ..... H01R 13/73

[52] U.S. Cl. ..... 439/573; 439/947

[58] Field of Search ..... 439/570–573, 439/607, 567, 947

[56] References Cited

U.S. PATENT DOCUMENTS

| | | | |
|---|---|---|---|
| 2,856,593 | 10/1958 | Gookin | 339/220 |
| 4,512,618 | 4/1985 | Kumar | 439/607 |
| 4,550,962 | 11/1985 | Czeschka | 339/17 LC |
| 4,721,470 | 1/1988 | Humphrey | 439/55 |
| 4,812,130 | 3/1989 | Altenschulte et al. | 439/84 |
| 4,911,659 | 3/1990 | Viselli | 439/570 |
| 5,022,863 | 6/1991 | Keens et al. | 439/108 |
| 5,085,589 | 2/1992 | Kan | 439/83 |
| 5,108,308 | 4/1992 | Northcraft et al. | 439/555 |
| 5,180,312 | 1/1993 | Sampson | 439/607 |
| 5,183,405 | 2/1993 | Elicker et al. | 439/108 |
| 5,249,974 | 10/1993 | Wang | 439/79 |
| 5,277,618 | 1/1994 | Mitra | 439/564 |

*Primary Examiner*—Khiem Nguyen
*Assistant Examiner*—Eugene G. Byrd
*Attorney, Agent, or Firm*—Daniel J. Long; M. Richard Page

[57] ABSTRACT

Disclosed is a clip for use in mounting an electrical connector to a printed circuit board (PCB). The clip includes a resilient first panel having a central opening or recess, a second panel also having a central opening or recess and being generally parallel to the first panel, a vertical support connecting the first and second conductive panels, a pair of resilient tin engaging arms suspended over the second conductive panel, and a vertical structure connecting the second panel to the pin engaging arms. Also disclosed is an assembly comprised of the clip as engaged with an electrical connector and a PCB.

18 Claims, 2 Drawing Sheets

DEVICE FOR MOUNTING AN ELECTRICAL CONNECTOR ON A PRINTED CIRCUIT BOARD

BACKGROUND OF THE INVENTION

1. Field of the Invention

The present invention relates to electrical connectors and more particularly to devices for attaching electrical connectors to a substrate.

2. Brief Description of Prior Developments

In various situations it may be desirable to mount a right angled receptacle on a printed circuit board (PCB) and at the same time ground a daughter board to the same PCB. Such a situation is illustrated, for example, in the 1995 Berg Electronics Catalog, page 17–58.

The apparatus illustrated in the Berg Electronics Catalog disclosed above makes use of a nut to fix a connector to a PCB. Situations, however, exist wherein it may be preferred to use alternate means to fix the receptacle in place.

There is, therefore, a need for a method and apparatus for fixing a right angled connector component to a PCB and at the same time ground a daughter board to the PCB which is particularly adapted for use in a situation wherein a rivet is used to mount the connector component to the PCB.

SUMMARY OF THE INVENTION

The assembly of this invention includes a PCB having a mounting surface and an opposed surface and a PCB aperture extending between said mounting surface and opposed surface. A component of an electrical connector having at least one mounting bracket comprising a footer member and a perpendicular member is positioned on the PCB. The footer element has a mounting surface and an opposed surface and an aperture extends through the footer element. The footer aperture is generally aligned with said PCB aperture. The perpendicular member has a transverse aperture in generally perpendicular relation to the footer aperture. A conductive pin extends through said transverse aperture in generally parallel relation to the footer member. A fastener means extends axially through the aligned footer aperture and PCB aperture for fixing the connector component to the PCB. A means for grounding the conductive pin extending through the conductive aperture of the perpendicular member of the bracket to the PCB is also provided.

Also encompassed in the invention is a conductive clip for fixing a component of an electrical connector to a PCB. The clip is comprised at a first conductive panel having a fastener means opening and interposed between the mounting sides of the footer member and the PCB. A second conductive panel having a fastener means opening and is superimposed over the opposed side of the footer member. A resilient conductive pin engagement means is suspended over the second conductive panel. Means are also provided for connecting the resilient conductive pin engagement means to the second conductive panel to the second conductive panel and for connecting the second conductive panel to the first conductive panel.

The assembly and clip of this invention are, in particular, adapted for use in a method and apparatus for mounting an electrical connector on a PCB which is disclosed in U.S. patent application Ser. No. 08/443,789, filed Apr. 8, 1995 which is assigned to the assignee of this application. The contents of this application Ser. No. 08/443,789 are incorporated herein by reference. Briefly, application Ser. No. 08/443,789 discloses a method and apparatus in which hold down projections extend upwardly from a tooling plate and the connector is then lowered toward the tooling plate until the hold down apertures are initially engaged with the tooling projection. Downward motion of the connectors continues until the pins first engage then are seated in the pin receiving apertures in the printed wiring board and the hold down apertures are fully engaged with the locating projection. An axial force is then applied downwardly to the eyelet against a deformation means in the tooling plate to bend the eyelet to engage the printed wiring board within its thickness and on its lower side. The eyelet also engages the connector on its upper side so as to fix the connector to the printed wiring board. By the term "eyelet" what is meant is any type of tubular rivet or other fastener which can engage a projection that fits through an aperture.

BRIEF DESCRIPTION OF THE DRAWINGS

The method and apparatus of the present invention is further described with reference to the accompanying drawings in which.

DETAILED DESCRIPTION OF THE PREFERRED EMBODIMENTS

Figure 2:
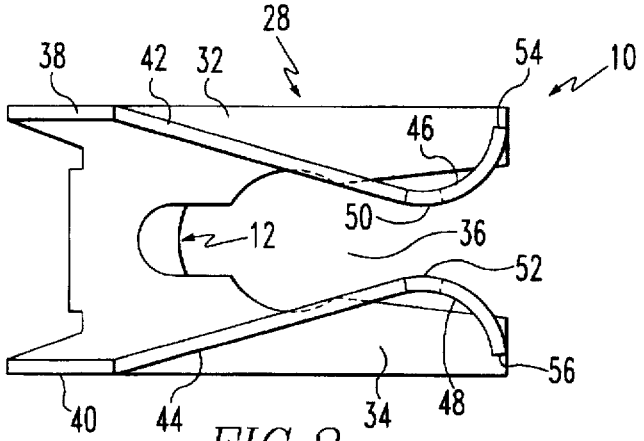
FIG. 2 is a top plan view of the clip shown in FIG. 1.
Figure 1:
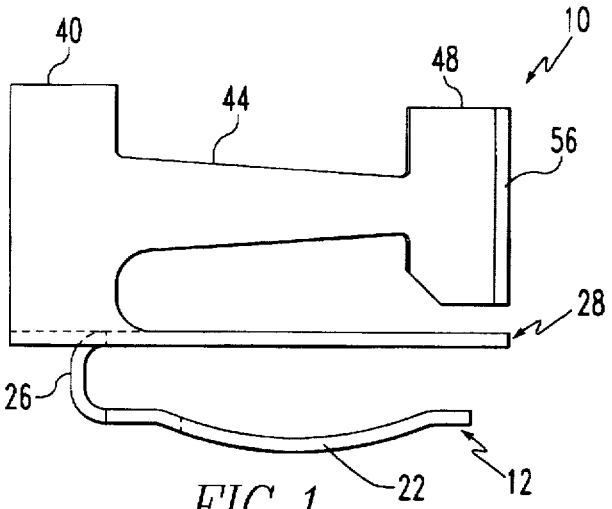
FIG. 1 is a side elevational view of a conductive clip used to fix an electrical connector to a PCB.
Figure 4:
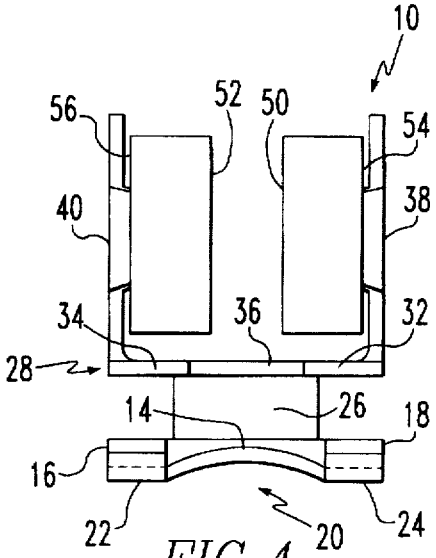
FIG. 4 is an end view of the clip shown in FIG. 1.
Figure 3:
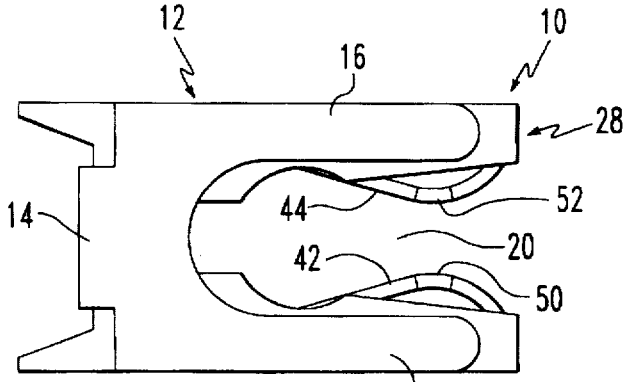
FIG. 3 is a bottom plan view of the clip shown in FIG. 1.

Referring to FIGS. 1–4, the conductive clip used in fixing an electrical connector to a PCB in accordance with the present invention is shown generally at numeral 10. This conductive clip includes a first resilient conductive panel member shown generally at numeral 12 which includes a transverse base 14 and opposed longitudinal arms 16 and 18 and a central recess 20 positioned between said longitudinal arms. In their relaxed position, the arms 16 and 18 have bowed sections respectively at 22 and 24. Extending upwardly from the base 14 there is a transverse vertical member 26 which connects the first conductive panel to a second horizontal conductive panel shown generally at numeral 28. This second conductive panel is comprised of a base 30. Opposed longitudinal arms 32 and 34 form a central recess 36 between the arms. From opposite sides of the base 30 longitudinal vertical connecting members 38 and 40 extend upwardly. Converging resilient longitudinal arms 42 and 44 extend from the vertical connecting members. At their terminals ends, these longitudinal arms have respectively vertically widened contact members 46 and 48 which have inner contact surfaces respectively at 50 and 52 and which diverge beyond those contact surfaces outwardly to terminal ends 54 and 56.

Figure 5:
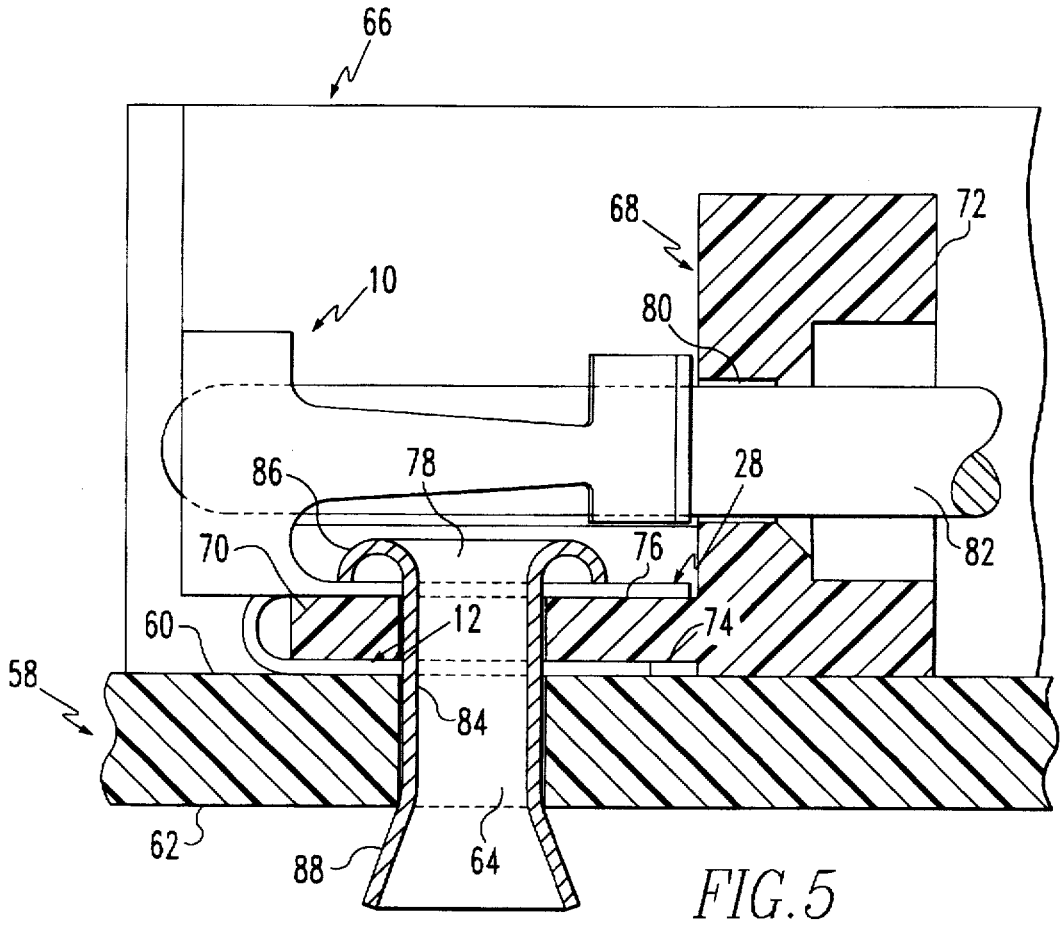
FIG. 5 is a side elevational view of the clip shown in FIG. 1 as engaged with an electrical receptacle and a printed circuit board, both shown in vertical cross section.

Referring to FIG. 5, it will be seen that the clip illustrated in FIGS. 1–4 and shown generally at numeral 10 may be used to fix a connector component to a PCB. The PCB is shown generally at numeral 58 and has a mounting surface 60 and an opposed surface 62 and a PCB aperture 64 extends transversely between the mounting surface 60 and the opposed surface 62. A receptacle shown generally at numeral 66 is positioned on the PCB and is fixed there to a mounting bracket shown generally at numeral 68. As is conventional, the mounting bracket has a mounting footer element 70 and a vertical element 72. The footer element has a mounting surface 74 and an opposed surface 76 and between these surfaces there is a transverse footer aperture 78. The vertical element has a vertical element aperture 80 which is perpendicular to the footer aperture and generally parallel to the footer. A conductive pin 82 which may, for example, be connected to another PCB (not shown) extends through the vertical element aperture and generally parallel relation to the footer element and the PCB 58. A tubular rivet 84 extends through the aligned footer aperture and PCB aperture and has an upper crimp 86 at its upper terminal end and a lower expansion 88 at its lower terminal end which serves to fix the rivet respectively to the footer element and the PCB. From FIG. 5 it will also be seen that the first conductive panel 12 is interposed between the mounting surfaces of the footer element and the PCB. It will further be observed that in this mounted position the first conductive panel is flexed out of its relaxed bowed position to a planar position. It will also be observed that the second conductive panel 28 is superimposed on the opposed surface of footer element. The upper crimp 86 of the tubular member bears against the second panel, and the recess 36 of the second panel allows an opening for the tubular rivet to pass through the footer aperture while at the same time the arms of the second conductive panel are in electrical contact with the tubular rivet. Similarly, the central recess of the first conductive panel allows an opening for the rivet to pass through the PCB aperture, but the longitudinal arms of the first panel are also in electrical contact with the tubular rivet. It will also be observed that the contact surface of the resilient longitudinal arms on the clips are in electrical contact with the conductive pin that extends through the vertical element aperture to ground that conductive pin to the PCB.

It will be appreciated that an assembly and a clip have been described which will allow an efficient and inexpensive means for securing an element of an electrical connector to a PCB while also allowing for the grounding of a conductive element which may, for example, extend from another PCB.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An assembly comprising:

(a) a printed circuit board (PCB) having a mounting surface and an opposed surface and a PCB aperture extending between said mounting surface and opposed surface;

(b) a component of an electrical connector having at least one mounting bracket said mounting bracket comprising a footer member and a perpendicular member wherein said footer element has a mounting surface and an opposed surface and an aperture extending between said mounting surface and opposed surface and said mounting surface is adjacent the mounting surface of the PCB aperture and said footer aperture is generally aligned with said PCB and said perpendicular member has a transverse pin receiving aperture;

(c) a conductive pin extending through said transverse aperture in generally parallel relation to said footer member;

(d) a conductive fastener means extending axially through the aligned footer aperture and PCB aperture for fixing the connector component to the PCB; and (e) a conductive footer engagement means abutting the mounting surface of the PCB and connected through a pair of conductive resilient opposed arms to the conductive pin extending through the conductive aperture of the perpendicular member of the bracket so as to around said conductive pin to the mounting surface of the PCB.

2. The assembly of claim 1 wherein the fastener means is a conductive tubular member having opposed first and second terminal ends and being fixed at said first terminal end to the mounting bracket and at said second terminal end at the PCB.

3. The assembly of claim 2 wherein the tubular member is fixed to the opposed side of the footer element of the bracket and to the opposed side of the PCB.

4. The assembly of claim 3 wherein the tubular member is deformed at its first terminal end adjacent the opposed side of the footer element and deformed at its opposed side adjacent the opposed side of the PCB.

5. The assembly of claim 1 where there is a first conductive panel having a fastener opening means interposed between the mounting side of the footer element and the mounting side of the PCB and a second conductive panel having a fastener opening means superimposed on the opposed side of the footer element and being connected to said first conductive panel.

6. An assembly comprising:

(a) a PCB having a mounting surface and an opposed surface and a PCB aperture extending between said mounting surface and opposed surface;

(b) a component of an electrical connector having at least one mounting bracket said mounting bracket comprising a footer member and a perpendicular member wherein said footer element has a mounting surface and an opposed aperture extending between said mounting surface is adjacent the mounting surface of the PCB and said footer aperture is generally aligned with said PCB and said perpendicular member having a transverse aperture in generally perpendicular relation to said footer aperture;

(c) a conductive pin extending through said transverse aperture in generally parallel relation to said footer member;

(d) a fastener means extending axially through the aligned footer aperture and PCB aperture for fixing the connector component to the PCB; and (e) a conductive clip comprising a first conductive panel having a fastener means opening and being interposed between the mounting sides of the footer member and the PCB, a second conductive panel having a fastener means opening and being superimposed over the opposed side of the footer member, resilient conductive pin engagement means suspended over the second conductive panel, means for connecting the resilient conductive pin engagement means to the second conductive panel to the second conductive panel to the first conductive panel.

7. The assembly of claim 6 wherein the fastener means is conductive.

8. The assembly of claim 7 wherein conductive footer engagement means contact the conductive fastening means.

9. The assembly of claim 8 wherein conductive pin engagement means are connected to the footer engagement means.

10. The assembly of claim 7 wherein the fastener means is a conductive tubular member having opposed first and second terminal ends and being fixed at said first terminal end to the mounting bracket and at said second terminal end at the PCB.

11. The assembly of claim 10 wherein the tubular member is fixed to the opposed side of the footer element of the bracket and to the opposed side of the PCB.

12. The assembly of claim 11 wherein the tubular member is deformed at its first terminal end adjacent the opposed side of the footer element and deformed at its opposed side adjacent the opposed side of the PCB.

13. The assembly of claim 8 where there is a first conductive panel having a fastener opening means interposed between the mounting side of the footer element and the mounting side of the PCB and a second conductive panel having a fastener opening means superimposed on the opposed side of the footer element and being connected to said first conductive panel.

14. The assembly of claim 13 wherein the pin engagement means comprises a pair of conductive resilient opposed arms.

15. A conductive clip for fixing a component of an electrical connector to a PCB comprising a first conductive panel having a fastener means opening and being interposed between the mounting sides of the footer member and the PCB, a second conductive panel having a fastener means opening and being superimposed over the opposed side of the footer member, resilient conductive pin engagement means suspended over the second conductive panel means for connecting the resilient conductive pin engagement means to the second conductive panel to the second conductive panel, and means for connecting the second conductive panel to the first conductive panel.

16. The conductive clip of claim 15 wherein the first and second conductive panels comprise a base section and a pair of arms extending from the base section to the medial fastener opening between said arms.

17. The conductive clip of claim 15 wherein the first and second conductive panels are generally parallel.

18. The conductive clip of claim 15 which is comprised of a resilient material.

* * * * *